US008844161B2

(12) United States Patent
Dreossi et al.

(10) Patent No.: US 8,844,161 B2
(45) Date of Patent: Sep. 30, 2014

(54) METHOD OF CONTROLLING A TUMBLE LAUNDRY DRIER

(75) Inventors: Giuseppe Dreossi, Portogruaro (IT); Maurizio Ugel, Fiume Veneto (IT)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 13/539,889

(22) Filed: Jul. 2, 2012

(65) Prior Publication Data

US 2012/0266486 A1 Oct. 25, 2012

Related U.S. Application Data

(62) Division of application No. 12/597,674, filed as application No. PCT/EP2008/003139 on Apr. 18, 2008, now Pat. No. 8,234,796.

(30) Foreign Application Priority Data

Apr. 30, 2007 (EP) ..... 07107266

(51) Int. Cl.
*D06F 58/28* (2006.01)

(52) U.S. Cl.
CPC ..... *D06F 58/28* (2013.01); *D06F 2058/2835* (2013.01); *D06F 2058/2838* (2013.01); *D06F 2058/2861* (2013.01); *D06F 2058/2829* (2013.01)
USPC ..... 34/491

(58) Field of Classification Search
CPC ..... D06F 58/28; D06F 2058/2825; D06F 2058/2835; D06F 2058/2838; D06F 2058/2861; D06F 2202/10
USPC ..... 34/491, 493, 524, 527, 572; 68/12.04
See application file for complete search history.

(56) References Cited

U.S. PATENT DOCUMENTS 4,733,479 A 3/1988 Kaji et al.
4,738,034 A 4/1988 Muramatsu et al.

(Continued)

FOREIGN PATENT DOCUMENTS

EP 0 226 209 6/1987
EP 1 108 809 6/2001

(Continued)

OTHER PUBLICATIONS

Machine translation of JP 2000229200A, Aug. 2000, Japan, Shimakage, Katsuyuki.*

(Continued)

*Primary Examiner* — Jiping Lu
(74) *Attorney, Agent, or Firm* — Banner & Witcoff, Ltd.

(57) ABSTRACT

A method of controlling a tumble laundry drier (1), the method including the steps of: starting a drying/ironing cycle and feeding drying air into the drum (5) from a drum input to a drum output; continuously measuring the electrical resistance/conductivity between two electrodes (25) located on the inside of the door; estimating the weight of the laundry inside the drum (5); measuring a temperature of the drying air at the drum output; stopping the drying/ironing cycle, if the weight of the laundry is above a weight threshold, when the electrical resistance/conductivity between the two electrodes (25) is above/below a resistance/conductivity threshold; and stopping the drying/ironing cycle, if the weight of the laundry is below a weight threshold, when the electrical resistance/conductivity between the two electrodes (25) is above/below a resistance/conductivity threshold and also when the temperature of the drying air at the drum output is above a temperature threshold.

1 Claim, 6 Drawing Sheets

(56) References Cited

U.S. PATENT DOCUMENTS

| | | | |
|---|---|---|---|
| 4,763,425 | A | 8/1988 | Grennan |
| 7,020,982 | B2 | 4/2006 | Park et al. |
| 2004/0006831 | A1 | 1/2004 | Kim et al. |

FOREIGN PATENT DOCUMENTS

| | | | | |
|---|---|---|---|---|
| EP | 1 321 563 | | | 6/2003 |
| EP | 1 508 637 | | | 2/2005 |
| GB | 2 175 416 | | | 11/1986 |
| JP | 60122600 | A | * | 7/1985 |
| JP | 2000229200 | A | * | 8/2000 |

OTHER PUBLICATIONS

European Search Report completed on Oct. 6, 2008 in related European Application No. 07107266.

International Search Report corresponding to International Application No. PCT/EP2008/003139, mailed Nov. 7, 2008.

* cited by examiner

METHOD OF CONTROLLING A TUMBLE LAUNDRY DRIER

CROSS-REFERENCE TO RELATED APPLICATION

This application is a divisional of co-pending U.S. application Ser. No. 12/597,674, filed Oct. 26, 2009, which is a national phase filing of International Application No. PCT/EP2008/003139, the contents of which are hereby incorporated by reference in their entirety.

TECHNICAL FIELD

The present invention relates to a method of controlling a tumble laundry drier, preferably for home use.

BACKGROUND ART

A standard home tumble laundry drier condenses a stream of hot air blown into a drying drum and which removes moisture from the laundry; and the front access to the drum is closed by a hinged panel-type front door. More specifically, a known laundry drier comprises a ventilation system (i. e. usually a blower comprising a fan and an electric fan motor) and a heating arrangement, which draw air from the outside and, via an appropriate conduit arrangement, heat and blow the air into and through the laundry drying drum. The hot drying air is then either exhausted directly from the drier or fed to condensing means to condense the moisture collected in the hot air.

In the past, the duration of a drying cycle was constant and predetermined. However, the weight and initial humidity of the laundry to be dried are variable, so that a drying cycle of fixed duration may be either too short (i.e. at the end of the drying cycle, the laundry is still too damp and the drying cycle therefore ineffective) or too long (i.e. the drying cycle has used too much energy and is therefore inefficient).

A modern tumble drier normally employs a sensor to measure the relative humidity of the laundry during the drying cycle and to stop the drying cycle when the humidity of the laundry reaches a given value depending on the drying cycle selected by the user. The most effective way of measuring humidity is a direct measurement of the conductivity of the laundry. Various solutions are already marketed, which measure the conductivity between the drum and metal inserts fixed to the drum outlet or the lifters, or in which the drum is divided into two halves, and conductivity measured in between.

A limitation of this last method lies in the restrictions imposed on the drum which, in this case, must be made of any conductive material (e.g., stainless steel) and cannot be lined with soft materials, such as thin silicone layers, because they are insulating. Consequently, the last method cannot be used in a tumble drier, in which "gentle treatment" of the laundry is achieved by lining the drum with soft materials.

To design the drum with no restrictions imposed by the humidity sensing system, a new so-called "Limited Conductimetric System" has been proposed, based on a pair of small electrodes fixed to a not-moving part of the machine, e.g. the inside of the door. The "Limited Conductimetric System" (today very common in the tumble dryers on the market) has a number of disadvantages: due to the limited contact surface between the electrodes and the laundry, this system is fairly unreliable in stopping the drying cycle in time, especially with small loads (for example, of less than 1 kg) and damp cycles (for example, a final humidity of over 3-4%). Even with standard loads and dry cycles, in some cases, problems may arise because the end-of-cycle condition is not totally repeatable. Tests show that a tumble drier using the "Limited Conductimetric System" rarely stops a drying cycle with less than a 1 kg load in time; and, for damp cycles, even a 2 kg load may be an issue.

In other words, with electrodes of this sort fixed to the inside of the door, it is fairly difficult (if not impossible) to design an algorithm reliable enough to stop the drying cycle in time in the case of small loads and/or damp cycles.

FIG. 1 shows a chart (relative to a roughly 3 kg load) comparing a first voltage signal measured using a "Traditional Conductimetric System", in which the drum is divided into two halves and conductivity measured in between (dotted line), and a second voltage signal measured using the "Limited Conductimetric System", in which a pair of small electrodes are fixed to the inside of the door (continuous line). In the "Traditional Conductimetric System" the laundry is always in good contact with the conductimetric system, even with very small loads (less than 1 kg), so the voltage signal is very smooth and regular (dotted line in FIG. 1). Conversely, in the "Limited Conductimetric System", the contact surface between the two electrodes and the laundry is fairly limited, so the voltage signal is irregular (continuous line in FIG. 1). Furthermore, the FIG. 1 chart relates to a 3 kg load; if we consider smaller loads, the situation with the "Limited Conductimetric System" is even worse, whereas the traditional conductimetric system is always reliable.

U.S. Pat. No. 4,531,305 discloses a laundry drier, in which the electrical resistance of wet articles and exhaust air temperature are monitored. The instant the monitored electrical resistance reaches a predetermined value, the time-varying rate of change of the monitored temperature is detected to estimate how long the drier is to be kept running; and, at the end of the estimated time period, the heat cycle of the drier is shut down.

EP0388939 discloses a laundry drier comprising, in a casing, a rotary drum for wet laundry, a motor for driving the rotary drum, electric heaters for heating the laundry, a temperature sensor for detecting a temperature in the rotary drum, an absolute humidity sensor for detecting absolute humidity in the rotary drum, and a control device for controlling operation of the laundry drier in response to outputs of the temperature sensor and absolute humidity sensor. The control device comprises circuit devices for powering the electric heaters in response to the output of the absolute humidity sensor.

EP1420104 discloses a process for drying laundry in a laundry enclosure or drum of a drying device, such as a drying machine, washer-drier or drying cabinet, and comprising one or more steps of drying the laundry in an airflow heated by heating means and fed into the laundry enclosure by ventilation means, and a step of ventilating the laundry in an airflow at ambient temperature fed into the laundry enclosure by the ventilation means, and in which the drying process begins with the ventilation step, to reduce the initial peak moisture content of the laundry by means of the airflow at ambient temperature. One embodiment also uses sensor means to detect the moisture content of the laundry, for example, by measuring the electrical conductivity of the laundry. This is done using a conductivity sensor (not shown in the drawings) comprising at least two metal electrodes (in contact with the laundry) inside the laundry enclosure. The power supplies to the heating means and fan means, and hence the duration of the individual steps, are calculated by a control unit on the basis of the temperature and/or conductivity readings, and optionally of the values entered by the user, and taking into account the laundry moisture reduction target values, particularly during the ventilation step.

SUMMARY STATEMENT OF OBJECTS AND ASPECTS OF INVENTION

It is an object of the present invention to provide a method of controlling a tumble laundry drier, designed to eliminate the aforementioned drawbacks, and which is cheap and easy to implement.

According to the present invention, there is provided a method of controlling a tumble laundry drier as claimed in the accompanying Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
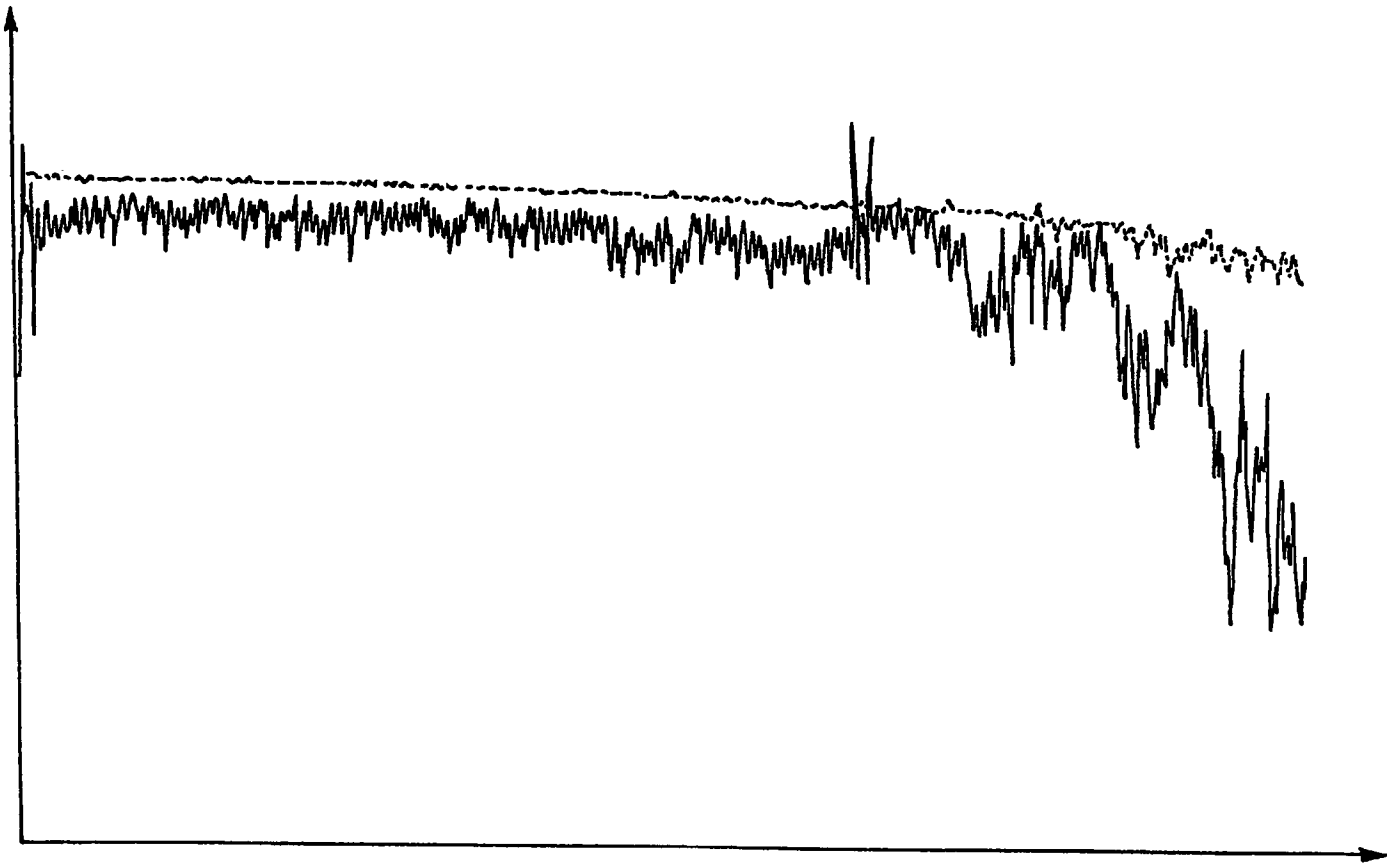
FIG. 1 shows a chart comparing a first voltage signal measured using a "Traditional Conductimetric System", and a second voltage signal measured using a "Limited Conductimetric System"
Figure 2:
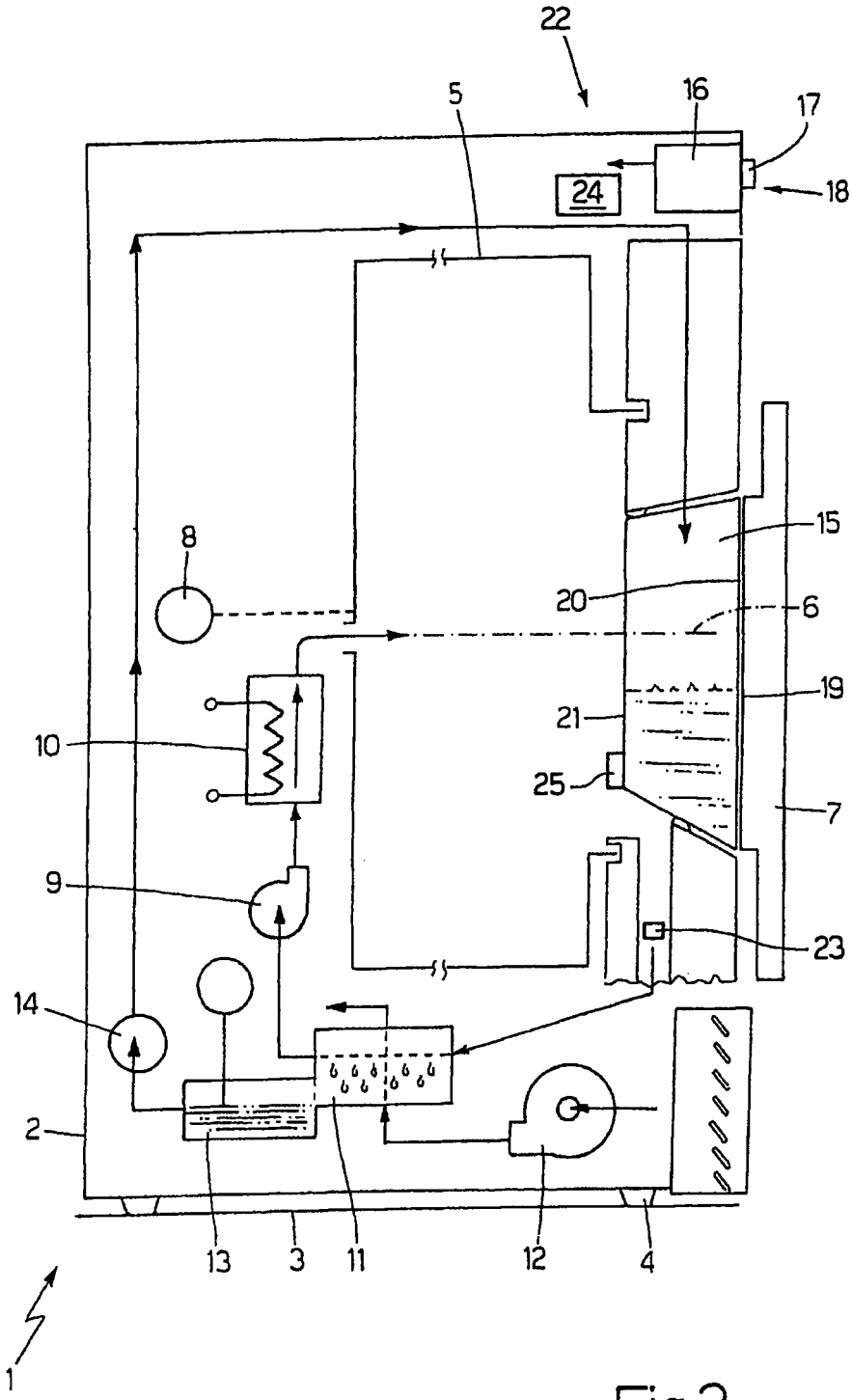
FIG. 2 shows a schematic side view of a laundry drier implementing a control method in accordance with the present invention.

Number 1 in FIG. 2 indicates as a whole a laundry drier comprising a casing 2 resting on a floor 3 on a number of feet 4. Casing 2 supports a revolving laundry drum 5 which rotates about a horizontal rotation axis 6 (in alternative embodiments not shown, rotation axis 6 may be tilted or vertical), and front access to which is closed by a door 7 hinged to a front wall of casing 2. Drum 5 is rotated by an electric motor 8, and is fed through with a stream of drying air fed into drum 5 by a centrifugal fan 9 and heated by heating elements 10.

The moisture in the laundry in drum 5 is released by evaporation to the stream of hot drying air; and the moist hot air from drum 5 is piped to a condenser 11, which is cooled by a stream of relatively cold air drawn in from the outside by a centrifugal aspirator 12.

In condenser 11, the vapour in the stream of hot air is condensed to liquid by cooling, and collects in a condenser reservoir 13; the dry air from condenser 11 is drawn by fan 9 and fed back into drum 5, subject to reheating by heating elements 10; and the outside air used for condensation is exhausted.

The condensation collected in condenser reservoir 13 is pumped by a pump 14 into a condensation tank 15 located at a higher level than condenser reservoir 13; and, when condensation tank 15 is full, a known level sensor (not shown) is activated to stop drier 1. Operation of the drier is controlled by a programmer 16 operated by buttons or knobs 17 on a front control panel 18.

Condensation tank 15 is fitted to door 7 closing the loading opening of drum 5, and contacts an inner wall 19 of door 7. More specifically, door 7 may comprise a housing removably housing condensation tank 15. An outer wall 20 of condensation tank 15 contacts inner wall 19 of door 7, and, when door 7 is in the closed position, an inner wall 21 of condensation tank 15 acts as a door cap to retain the laundry inside drum 5. In other words, when door 7 is in the closed position, inner wall 21 of condensation tank 15 closes the front access opening to drum 5 to retain the laundry inside drum 5, so that tank 15 acts as both a water container and the so-called door cap for retaining the laundry inside drum 5.

Figure 3:
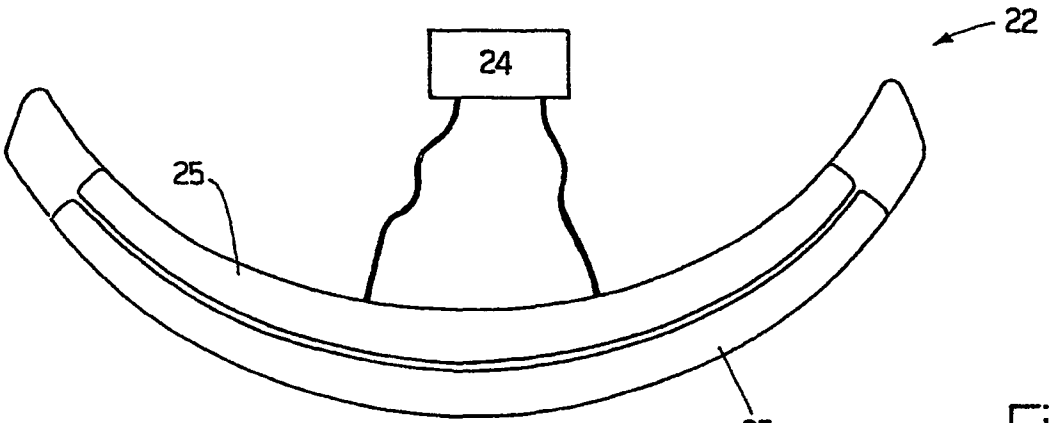
FIG. 3 shows a schematic view of a pair of small electrodes fixed to the inside of a door of the FIG. 1 laundry drier.

Programmer 16 is connected to a humidity sensor 22 to measure the relative humidity of the laundry during a drying cycle, and to a temperature sensor 23 to measure the temperature of the moist hot air from drum 5. Humidity sensor 22 comprises a measuring unit 24; and a pair of small electrodes 25 (shown more clearly in FIG. 3), which are arc-shaped, are fixed to the inside of door 7, and are electrically connected to measuring unit 24. The resistance/conductivity $R_X$ of the laundry inside drum 5 is measured between the two electrodes 25 and is used to determine the humidity of the laundry.

Figure 4:
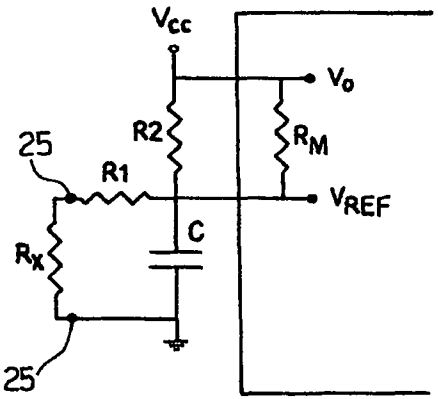
FIG. 4 shows a schematic view of an electric circuit for measuring the resistance between the FIG. 3 electrodes.

FIG. 4 shows an example of an electric circuit 26 designed to interface electrodes 25 to measuring unit 24; $R_X$ is the resistance of the laundry, and $R_M$ the internal impedance of measuring unit 24. The value of $R_X$ can be worked out fairly easily by measuring the voltage between $V_{CC}$ and $V_{REF}$ (let's call it $V_O$). Basically this simple schematic provides a voltage $V_O$ that is then converted to laundry resistance/conductivity $R_X$. The algorithm that will be described only takes into account the $V_O$ signal, but may easily be applied directly to the $R_X$ data.

The main weak point of electrodes 25 is the fairly limited contact surface between them and the laundry, so that contact between electrodes 25 is uncertain. In other words, as it rotates inside drum 5, the laundry moves to and from the two electrodes 25, so that the contact resistance between the laundry and the two electrodes 25 varies continuously, particularly with a small amount of laundry, which is more mobile than a full laundry load.

Figure 5:
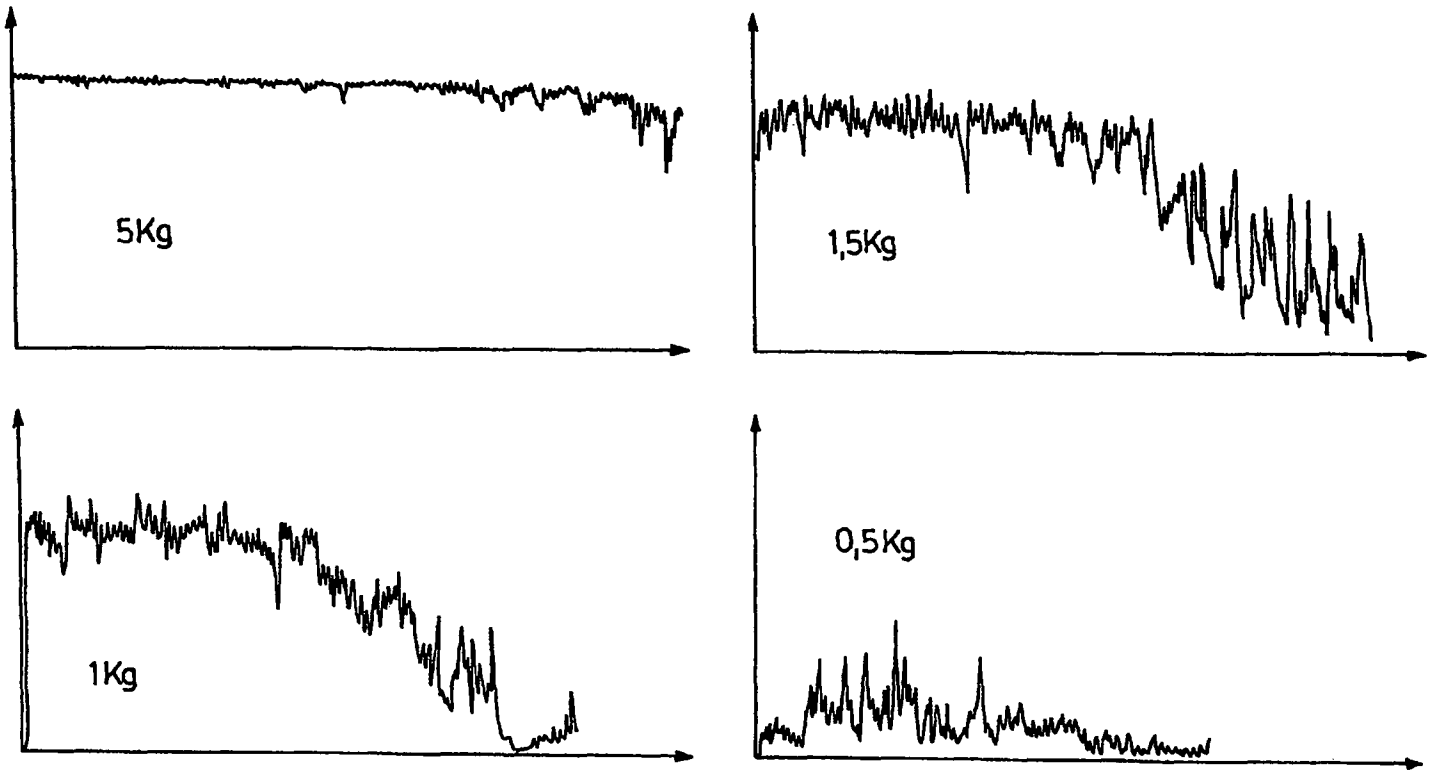
FIG. 5 shows a chart comparing four voltage signals measured by the FIG. 4 electric circuit with different loads.

As a result, the signal emitted by the two electrodes 25 is fairly noisy, as shown in FIG. 5 test charts.

Massive data acquisition from numerous laboratory tests demonstrates the validity of the following assumptions. The signal emitted by the two electrodes 25 has a high noise level (as compared with a Traditional Conductimetric System) because, while drum 5 is rotating, the laundry is in random movement, so the laundry actually in contact with the electrodes changes continuously; as a result, voltage $V_0$ and resistance $R_x$ measured by measuring unit 24 are unstable.

The signal measured by measuring unit 24 is more stable with large than with small loads, because, with large loads, the laundry is statistically much more likely to come into contact with electrodes 25. Consequently, the "amount of noise" or "vibration" overlapping the average signal measured by measuring unit 24 is in inverse proportion to the size of the load.

As the amount of noise (or vibration) depends solely on random contact of the laundry with electrodes 25, the amount of humidity of the laundry has no effect as long as it is stable, i.e. at the beginning of the drying cycle, for the first 10-60 minutes (depending on the initial absolute amount of water in the laundry).

The average value of the $V_0$ (or $R_x$) signal measured by measuring unit 24 depends on the relative humidity of the laundry and on the size of the contact surface; and the size of the contact surface depends on the size of the load.

Given the above, it has been found possible to measure the weight of the laundry (to an accuracy of 0.5-1 kg) from 0 to 6 kg by evaluating the amount of noise in the signal measured by measuring unit 24. In other words, the weight of the laundry inside drum 5 is estimated by evaluating the noise level in the instantaneous values of the electrical resistance/conductivity measured between the two electrodes 25. For example, the weight of the laundry inside drum 5 is estimated below a weight threshold if the noise level in the instantaneous values of the electrical resistance/conductivity measured between the two electrodes 25 is above a noise level threshold, and the weight of the laundry inside drum 5 is estimated above the weight threshold if the noise level in the instantaneous values of the electrical resistance/conductivity measured between the two electrodes 25 is below the noise level threshold.

At the start of the drying cycle, the weight of the laundry inside drum 5 can therefore be estimated. More specifically, it is possible to determine whether the weight of the laundry inside drum 5 is above or below the weight threshold. In a different embodiment, the weight of the laundry inside drum 5 may be measured differently, or may be entered by the user pressing a small load button on programmer 16.

Figure 6:
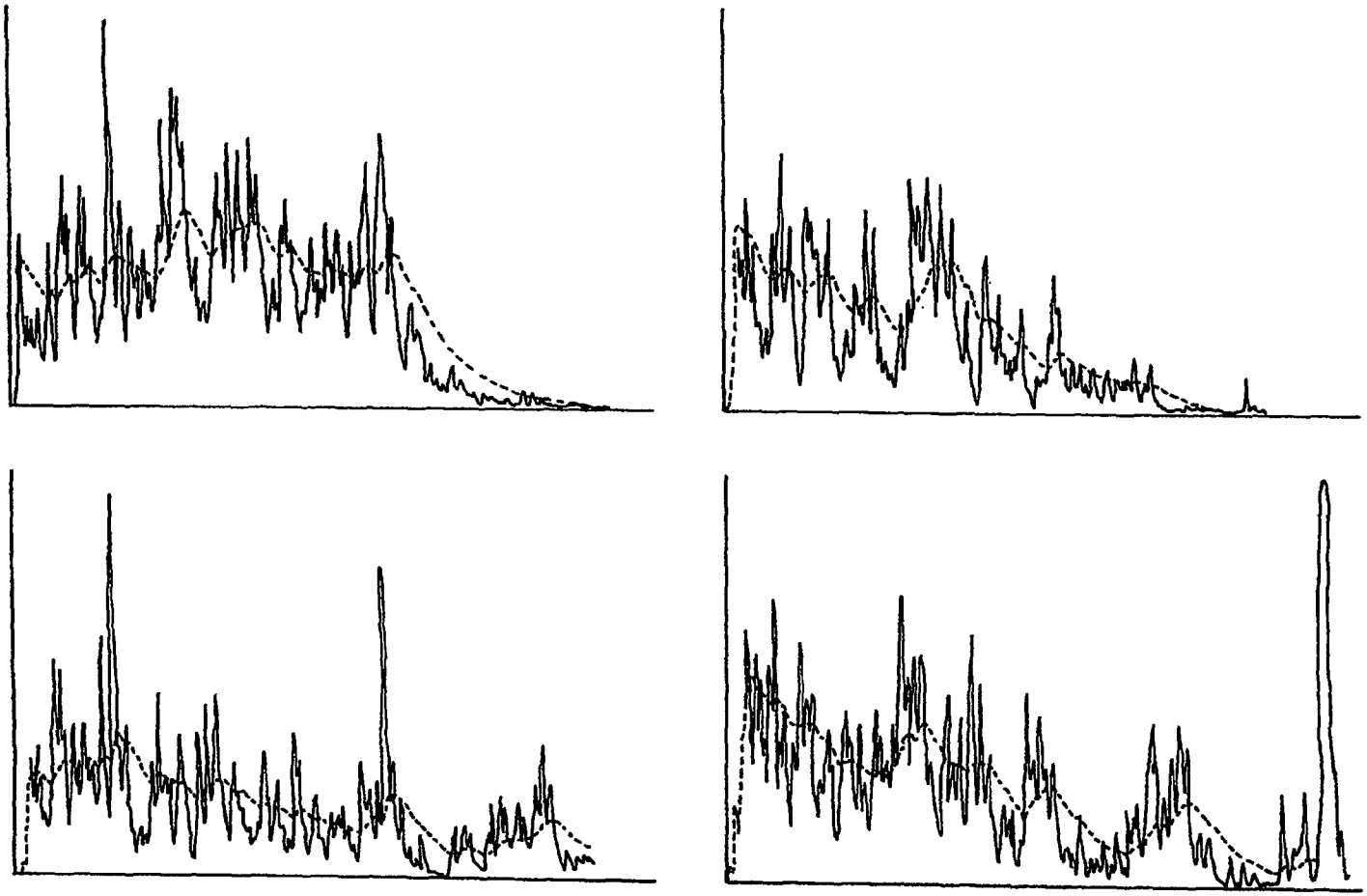
FIG. 6 shows a chart comparing four voltage signals measured by the FIG. 4 electric circuit with a 0.5 kg load.

By applying to the signal measured by measuring unit 24 (i.e. the electrical resistance/conductivity between the two electrodes 25) a low-pass filter with a time constant, a smoother, much easier-to-handle curve can be obtained, as shown in the FIG. 6 test charts, in which the continuous line shows the instantaneous values of the electrical resistance/conductivity measured between the two electrodes 25, and the dotted line shows the average value of the electrical resistance/conductivity measured between the two electrodes 25. In other words, measuring the electrical resistance/conductivity between the two electrodes 25 also comprises calculating an average value of the instantaneous electrical resistance/conductivity in a given time frame by applying a low-pass filter to the instantaneous electrical resistance/conductivity.

Analysis of the results of numerous laboratory tests shows that, if the weight of the laundry is above the weight threshold, the drying/ironing cycle can be stopped when the electrical resistance/conductivity between the two electrodes 25 is above/below a resistance/conductivity threshold. In other words, if the weight of the laundry is above the weight threshold, the decision to end the drying/ironing cycle is based solely on the electrical resistance/conductivity measured by measuring unit 24

For example, the weight threshold may be set to about 0.5 kg for a drum 5 having a maximum load of 6 kg.

However, there is still an issue if the weight of the laundry is below the weight threshold. In which case, it is useful to also use the temperature information from temperature sensor 23. The idea is that the drying/ironing cycle must not be stopped if the load is not warm enough: therefore, the temperature of the air at drum output has to reach a specific value (temperature threshold) before stopping the drying/ironing cycle; whenever this temperature threshold is reached at least once, the drying/ironing cycle is stopped if the electrical resistance/conductivity between the two electrodes 25 is above/below the resistance/conductivity threshold. The temperature threshold is set, for example, to 75° C. for all drying/ironing cycles, and obviously depends on the type of temperature sensor {NTC, thermocouple . . . } and on its position outside drum 5.

Figure 7:
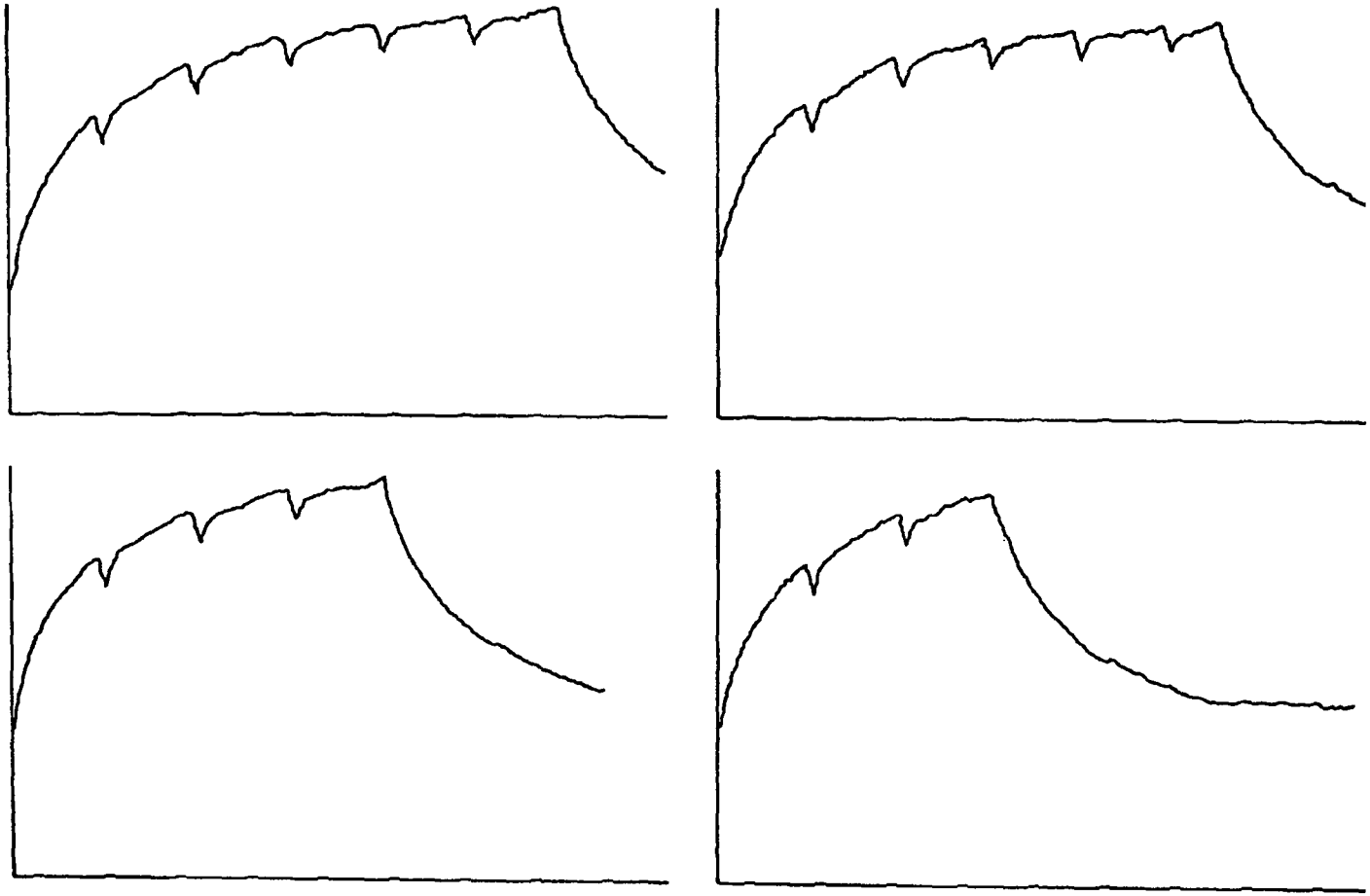
FIG. 7 shows a chart comparing four temperature signals measured by a temperature sensor.

FIG. 7 shows a chart comparing four temperature signals measured by temperature sensor 23 during different tests; the temperature signal measured by temperature sensor 23 increases gradually during the drying/ironing cycle, and decreases rapidly after the end of the drying/ironing cycle.

In short, the control method described provides for estimating the weight of the laundry inside drum 5; measuring a temperature of the drying air at the drum output; stopping the drying/ironing cycle, if the weight of the laundry is above the weight threshold, when the electrical resistance/conductivity between the two electrodes 25 is above/below a resistance/conductivity threshold; and stopping the drying/ironing cycle, if the weight of the laundry is below a weight threshold, when the electrical resistance/conductivity between the two electrodes 25 is above/below the resistance/conductivity threshold and also when the temperature of the drying air at the drum output is above the temperature threshold.

In a preferred embodiment, the resistance/conductivity threshold is not constant and depends on the type of cycle (drying or ironing) and on the weight of the laundry inside drum 5. More specifically, the resistance/conductivity threshold is lower/higher for the ironing cycle than for the drying cycle; furthermore, the greater the weight of the laundry inside drum 5, the lower/higher the resistance/conductivity threshold is.

The laundry drier control method described above has numerous advantages, by being cheap and easy to implement, and by effectively and efficiently determining when to stop the drying/ironing cycle. As a result, the Traditional Conductimetric System, which imposes important restrictions in drum design/construction, may be replaced by a new Limited Conductimetric System, which imposes no restrictions on the drum, while maintaining the same drying performance.

The invention claimed is:

1. A method of measuring the weight of the laundry inside a drum of a tumble laundry drier; the method comprising the steps of:

starting a drying/ironing cycle and feeding drying air into the drum from a drum input to a drum output; and continuously measuring the electrical resistance/conductivity between two electrodes contacting the laundry inside the drum;

the method being characterized by comprising the step of:

estimating the weight of the laundry inside the drum by evaluating a noise level of a signal representing instantaneous values of the electrical resistance/conductivity measured between the two electrodes over time, wherein the weight of the laundry inside the drum is estimated to be below a weight threshold if the noise level of the signal is above a noise level threshold, and the weight of the laundry inside the drum is estimated to be above the weight threshold if the noise level of the signal is below the noise level threshold.

* * * * *